US007523790B2

(12) United States Patent
Arakawa et al.

(10) Patent No.: US 7,523,790 B2
(45) Date of Patent: Apr. 28, 2009

(54) RECIPROCATING POWER TOOL HAVING A VIBRATION-DAMPING HANDLE

(75) Inventors: Takuo Arakawa, Anjo (JP); Yoshihiro Kasuya, Anjo (JP)

(73) Assignee: Makita Corporation, Anjo-shi (JP)

( * ) Notice: Subject to any disclaimer, the term of this patent is extended or adjusted under 35 U.S.C. 154(b) by 0 days.

(21) Appl. No.: 11/388,995

(22) Filed: Mar. 27, 2006

(65) Prior Publication Data

US 2006/0219418 A1 Oct. 5, 2006

(30) Foreign Application Priority Data

Mar. 29, 2005 (JP) ..... 2005-095770

(51) Int. Cl.
*B25D 17/00* (2006.01)

(52) U.S. Cl. ..... 173/162.2; 173/162.1

(58) Field of Classification Search ..... 173/162.2, 173/162.1
See application file for complete search history.

(56) References Cited

U.S. PATENT DOCUMENTS 4,478,293 A * 10/1984 Weilenmann et al. .... 173/162.2
4,667,749 A 5/1987 Keller
4,921,053 A * 5/1990 Dobry et al. ..... 173/162.2
5,522,466 A 6/1996 Harada et al.
5,697,456 A 12/1997 Radle et al.
6,148,930 A * 11/2000 Berger et al. ..... 173/162.2

FOREIGN PATENT DOCUMENTS

EP 1 510 298 3/2005
JP A-1-18306 5/1989

* cited by examiner

*Primary Examiner*—Brian D Nash
(74) *Attorney, Agent, or Firm*—Oliff & Berridge, PLC

(57) ABSTRACT

It is an object of the invention to provide an effective technique for enhancing the effect of reducing vibration of a grip of a reciprocating power tool. According to the present invention, a representative reciprocating power tool may comprise a tool bit, a tool body and a grip. The grip is connected to the tool body via an elastic element and a vibration damping part. The elastic element is resiliently disposed between the tool body and the grip and serves to absorb vibration transmitted from the tool body to the grip during operation. The vibration damping part is disposed between the tool body and the grip and serves to damp and/or attenuate the vibration. According to the invention, the spring constant of the elastic element can be made smaller due to vibration damping part.

8 Claims, 6 Drawing Sheets

RECIPROCATING POWER TOOL HAVING A VIBRATION-DAMPING HANDLE

BACKGROUND OF THE INVENTION

1. Field of the Invention

The present invention relates to a reciprocating power tool and more particularly, to a mounting structure of a grip of a hand-held reciprocating power tool such as an electric hammer and hammer drill reciprocating a tool bit at a certain cycle.

2. Description of the Related Art

Japanese non-examined laid-open Utility Model Publication No. 1-18306 (D1) discloses an electric hammer having a vibration-proof grip. In the known electric hammer, the grip that the user holds is connected via an elastic element made of rubber to a body of the hammer in which vibration is caused.

With such construction, vibration transmitted from the hammer body to the grip can be absorbed via the elastic element. In order to maximize the effect of absorbing vibration, the spring constant of the elastic element must be small. However, if the spring constant is small, the grip and the hammer body are held unsteady with respect to each other and therefore, the spring constant of the elastic element must be set large enough to avoid such unsteadiness.

SUMMARY OF THE INVENTION

Accordingly, it is an object of the invention to provide an effective technique for enhancing the effect of reducing vibration of a grip of a reciprocating power tool.

According to the present invention, a representative reciprocating power tool may comprise a tool bit that performs an operation by reciprocating in the axial direction, a tool body that houses an actuating mechanism for driving the tool bit, and a grip mounted on the rear end of the body on the side opposite to the tool bit. The "reciprocating power tool" typically comprises any tool of the type which performs an operation while the user holds the grip and applies a pressing force on the grip in the direction of the tool body. Specifically, the "reciprocating power tool" includes impact power tools such as an electric hammer and a hammer drill, which performs fracturing or drilling operation on a workpiece by causing a tool bit to perform only hammering movement in the axial direction or the hammering movement and rotation in the circumferential direction in combination. In addition to such impact power tools, it may include cutting tools such as a reciprocating saw or a jig saw, which performs a cutting operation on a workpiece by causing a blade to perform a reciprocating movement.

According to the invention, the grip is connected to the tool body via an elastic element and a vibration damping part. The elastic element is resiliently disposed between the tool body and the grip and serves to absorb vibration transmitted from the tool body to the grip ring operation. The vibration damping part is also disposed between the tool body and the grip and serves to damp and/or attenuate the vibration. Preferably, the direction of input of the biasing force of the elastic element and the direction of damping action of the vibration damping part may generally coincide with the direction of input of vibration or the axial direction of the tool bit. The "elastic element" may comprise a rubber or a spring.

Further, the manner of "damping vibration" typically includes the manner of damping vibration by utilizing frictional resistance that acts on the sliding parts when two elements move in contact with each other. Otherwise, the manner of damping vibration by utilizing resistance produced when fluid passes though an orifice within a space of which capacity varies by the relative movement of the two elements. According to the invention, because the vibration during the operation of the power too is reduced by the elastic element in association with the vibration damping part, the spring constant of the elastic element can be made smaller without causing unstable connection between the tool body and the grip. Therefore, vibration transmitted from the tool body to the grip during operation by the reciprocating power tool is effectively reduced by the vibration absorbing action caused by the elastic deformation of the elastic body and by the damping action of the vibration damping part.

Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved reciprocating power tools and method for using such reciprocating power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
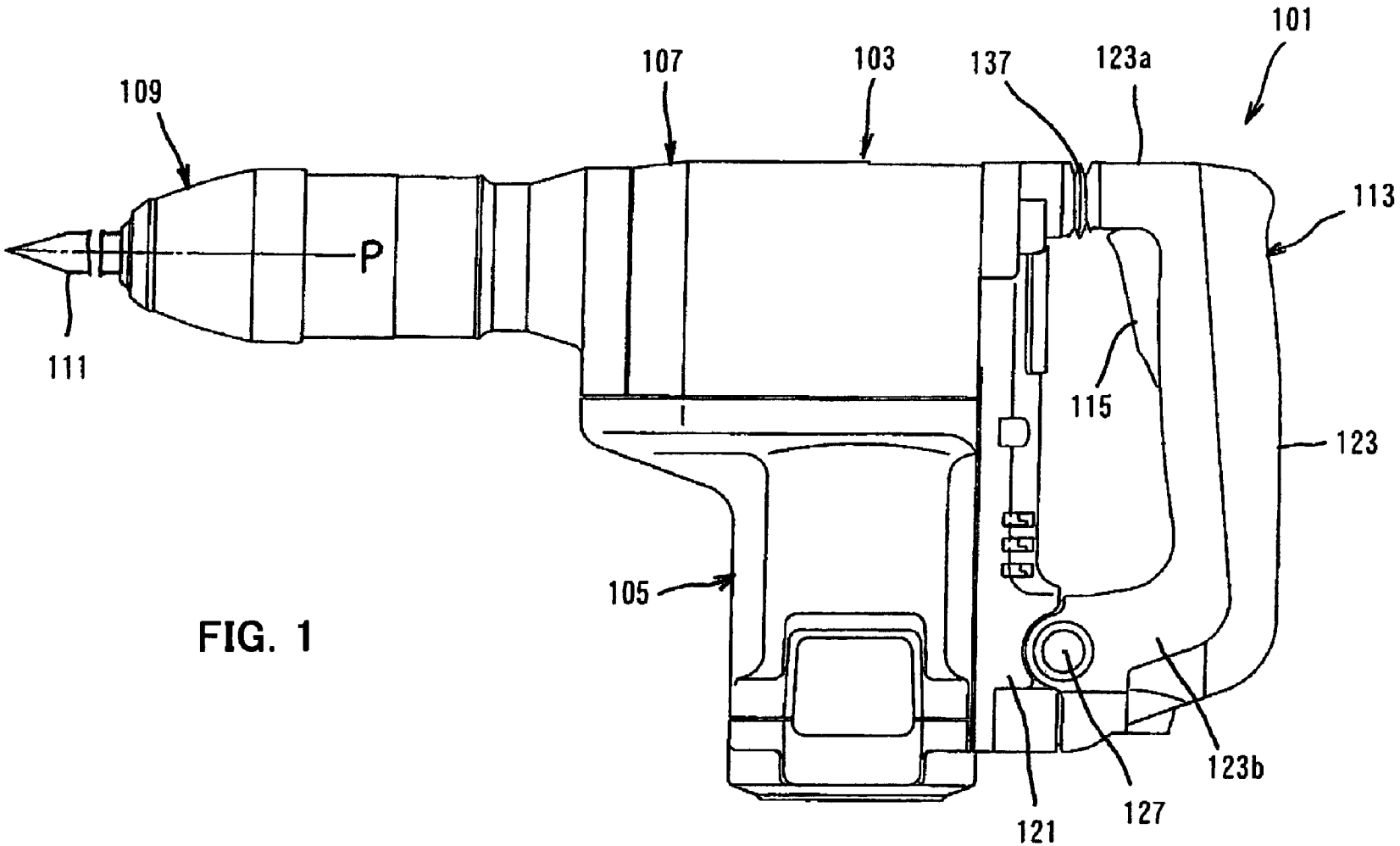
FIG. 1 is a side view showing an entire electric hammer according to an embodiment of the invention.

A representative embodiment of the present invention will now be described with reference to the drawings. FIG. 1 is a side view of an entire electric hammer 101 as a representative embodiment of a reciprocating power tool according to the invention. As shown in FIG. 1, the electric hammer 101 includes a body 103. The body 103 is a feature that corresponds to the "tool body" according to the invention. The body 103 includes a motor housing 105, a gear housing 107 and a tool holder 109 in the tip end (front end) region of the gear housing 107. A hammer bit 111 is mounted in the tool holder 109 such that the hammer bit 111 can move in the axial direction with respect to the tool holder 109 and can rotate in the circumferential direction together with the tool holder 109. The hammer bit 111 is a feature that corresponds to the "tool bit" according to the invention. Further, a handgrip 113 held by the user during operation is mounted on the rear end of the body 103. In the embodiment, for the sake of convenience of explanation, the side of the hammer bit 11 is taken as the front side and the side of the handgrip 113 as the rear side.

An impact driving mechanism (not shown) is disposed within the body 103 and serves to transmit a striking movement to the hammer bit 111 retained by the tool holder 109. The impact driving mechanism is know in the art and therefore will be explained only briefly. A driving motor as a source is disposed within the motor housing 105. The rotating output of the driving motor is converted into reciprocating motion of a piston via a crank mechanism disposed within the gear housing 107. When the piston linearly moves, a striker linearly moves toward the tip end (forward) at high speed by the action of a so-called air spring caused within the cylinder by the linear movement of the pistol. The striker then collides with an impact bolt as an intermediate element. The impact bolt, in turn, linearly moves forward at high speed and collides with the hammer bit 111. The hammer bit 11 then linearly moves in the axial direction (forward) at high speed. Thus, the hammer bit 11 performs a striking (hammering) movement and as a result, hammering operation such as chipping is performed on a workpiece (not shown). The driving motor 113 is stud or stopped by operating a trigger 115 on the handgrip 113 to turn a power switch to the "ON" or "OFF" position.

Figure 2:
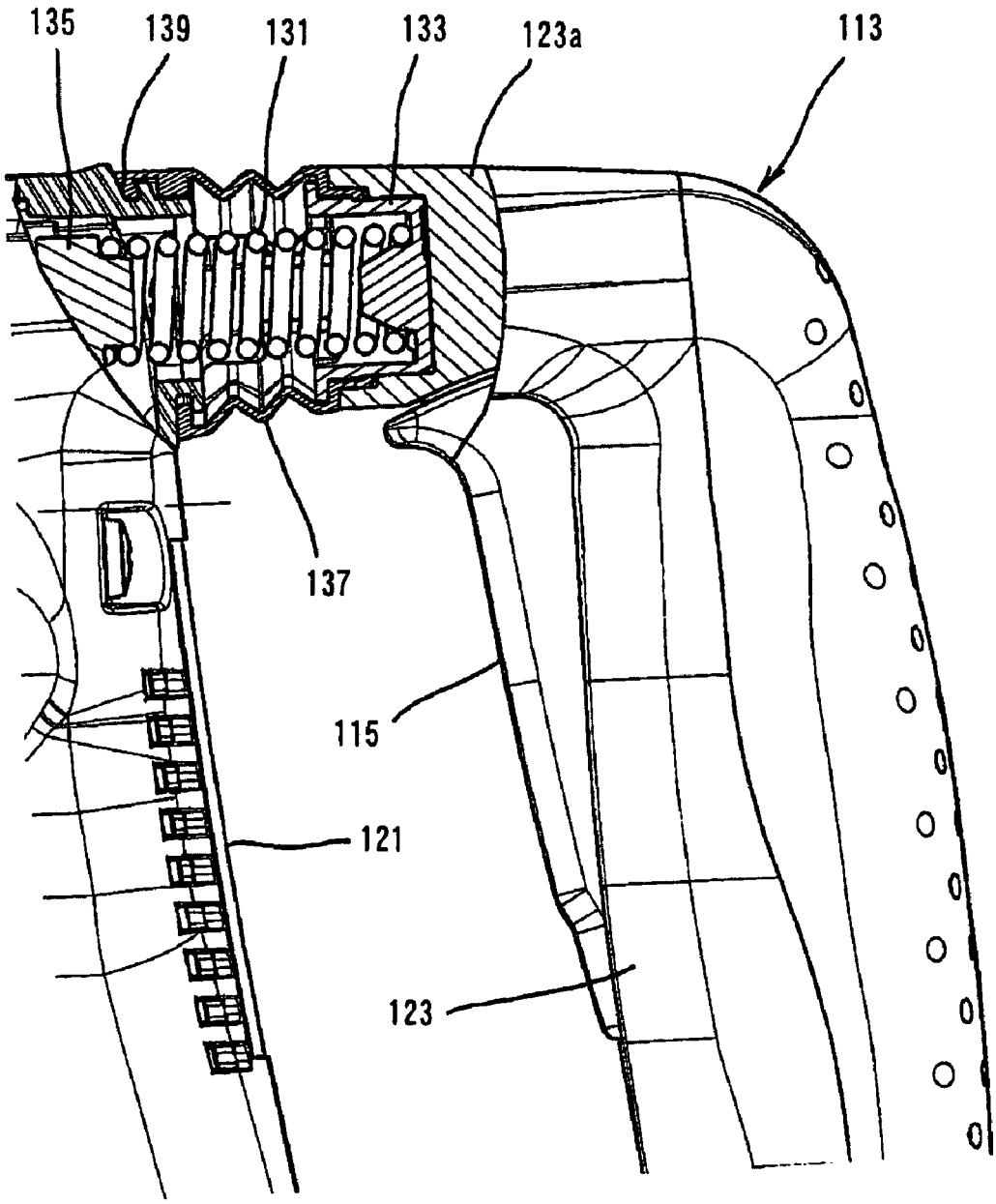
FIG. 2 is a side sectional view, showing the construction for mounting the upper end portion of a handgrip to the body.
Figure 3:
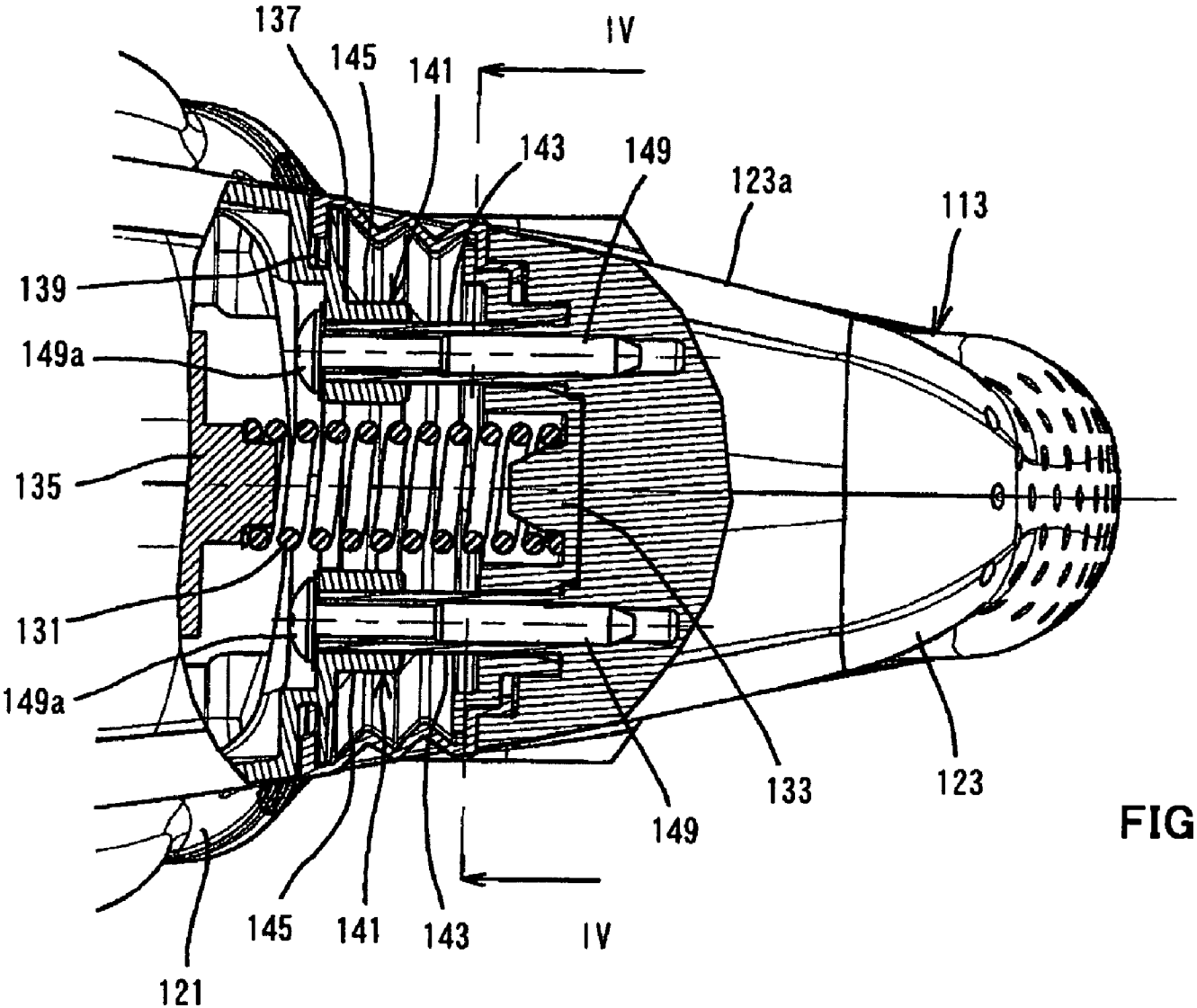
FIG. 3 is a partial plan sectional view of the handgrip.
Figure 4:
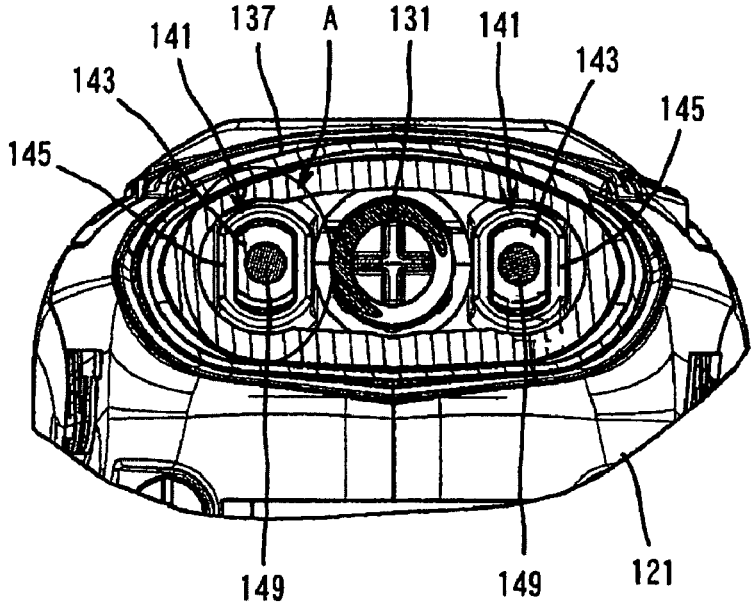
FIG. 4 is a sectional view taken along line IV-IV in FIG. 3.
Figure 5:
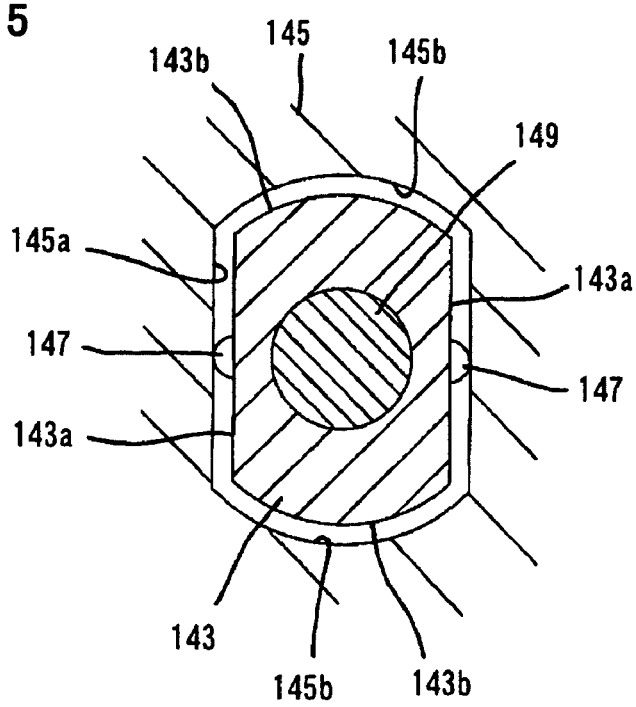
FIG. 5 is an enlarged view of the circled part A in FIG. 4.
Figure 6:
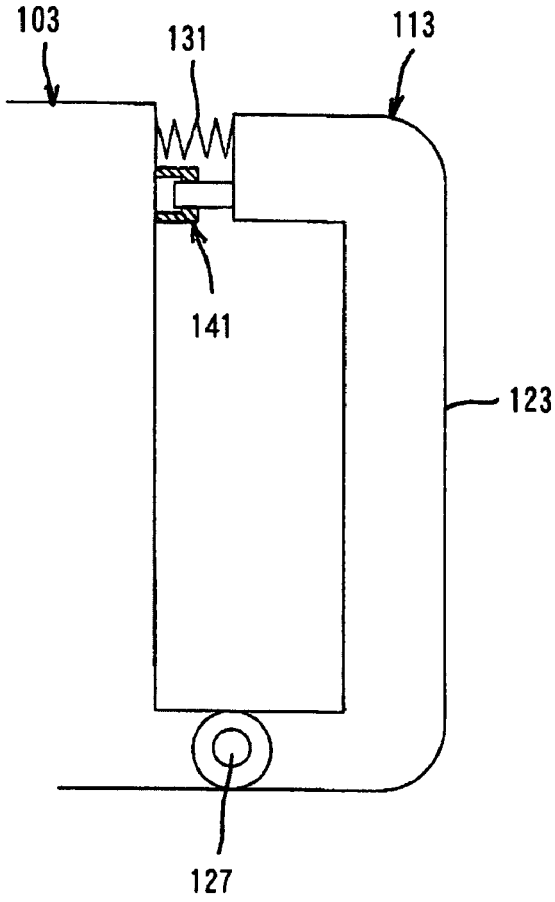
FIG. 6 schematically shows the construction for mounting the handgrip to the body.

The striker and the impact bolt form a striking mechanism which transmits a striking movement to the hammer bit 111. The striking mechanism and the hammer bit 111 move linearly substantially along the same line. Upon striking movement of the hammer bit 111, vibration is caused in the body 103 in the axial direction of the hammer bit 111. In order to reduce transmission of such vibration to the handgrip 113, the handgrip 113 is mounted to the body 103 in the following manner. The construction for mounting the handgrip 113 to the body 103 will now be explained with reference to FIGS. 1 to 6. FIG. 2 is a partial side sectional view showing the construction for mounting the upper end portion of the handgrip 113 to the body 103. FIG. 3 is a partial plan sectional view also showing the mounting construction of the upper end portion of the handgrip 113. FIG. 4 is a sectional view taken along line IV-IV in FIG. 3. FIG. 5 is an enlarged view of the circled part A in FIG. 4. FIG. 6 schematically shows the construction for mounting the handgrip 113 to the body 103.

The handgrip 113 comprises a synthetic resin covering 121 and a grip 123. The covering 121 is arranged to cover the rear portion of the body 103. The grip 123 comprises a metal portion and a synthetic resin potion joined together and is mounted to the covering 121. The covering 121 is fastened to the rear portions of the gear housing 107 and motor housing 105 which form the body 103, by screws (not shown) at predetermined several points. Therefore, the covering 121 is secured to the body 103 and substantially defined as a member on the body 103 side.

As shown in FIGS. 1 and 2, the grip 123 extends vertically in a direction crossing the axial direction of the hammer bit 111. Mounting legs 123*a* and 123*b* extend a predetermined length from the extending ends or the upper and lower ends of the grip 123 in a direction generally parallel to the axial direction of the hammer bit 111 (in a horizontal direction). The grip 123 having the mounting legs 123*a*, 123*b* is thus generally U-shaped in side view. As schematically shown in FIG. 6, the upper end mounting leg 123*a* is connected to the body 103 via an elastic element in the form of a coil spring 131 and a vibration damping mechanism 141. The lower end mounting leg 123*b* is connected to tile body 103 via a pivot 127 such that it can pivot with respect to the body 103. The construction for mounting the mounting legs 123*a*, 123*b* will now be explained.

As shown in FIGS. 2 and 3, the coil spring 131 is resiliently disposed between the mounting leg 123*a* on the upper end of the grip 123 and the gear housing 107 and serves to absorb vibration of the grip 123 during operation. The coil spring 131 is a feature that corresponds to the "elastic element" according to the invention. The coil spring 131 is disposed such that the direction of action of its spring force generally coincides with the axial direction of the hammer bit 111 or the direction of input of vibration. The coil spring 131 is disposed in a position near a line of travel P of the reciprocating hammer bit 111 or in a position slightly above a line of extension of the axis of the hammer bit 111. One end of the coil spring 131 is supported by a spring receiver 133 on the grip 123 side. The other end of the coil spring 131 extends into the gear housing 107 through the covering 121 and is supported by a spring receiver 135 fixed on the gear housing 107. The mounting leg 123*a* on the upper end of the grip 123 is thus connected to the body 103 via the coil spring 131. The spring receiver 133 on the grip 123 side also serves to hold an elastic cover 137 which will be described below.

The mounting leg 123*b* on the lower end of the grip 123 is connected to the rear lower end of the covering 121 via the pivot 127 such that it can pivot on the horizontal pivot with respect to the body 103. The grip 123 is designed such that the direction of the relative pivotal movement via the pivot 127 generally coincides with the axial direction of the hammer bit 111 or the direction of input of vibration. With such construction, the vibration absorbing function of the coil spring 131 is effectively performed with respect to the vibration in the axial direction of the hammer bit 111 transmitted from the body 103 to the grip 123 via the covering 121.

Further, as shown in FIGS. 3 and 4, the mounting leg 123*a* on the upper end of the grip 123 is connected to the covering 121 on the body 103 side via the vibration damping mechanism 141 that damps and attenuates vibration by means of friction. The vibration damping mechanism 141 is a feature that corresponds to the "vibration damping part" according to the invention. The vibration damping mechanism 141 comprises a rod-like element 143 and a cylindrical element 145 that move (pivot on the pivot 127) with respect to each other. The rod-like element 143 is a feature that corresponds to the "grip-side sliding part" and the "first element", and the cylindrical element 145 corresponds to the "body-side sliding part" and the "second element" according to the invention. The rod-like element 143 is a linear element that is integrally formed with the mounting leg 123*a* on the upper end of the grip 123. The rod-like element 143 extends generally parallel to the travel line P of the hammer bit 111 (and thus generally parallel to the coil spring 131) from the mounting leg 123*a* toward the gear housing 107. The rod-like element 143 is inserted into the bore of the cylindrical element 145 integrally formed with the covering 121 such that the rod-like element 143 can move with respect to the cylindrical element 145. Further, a stopper bolt 149 is screwed into the rod-like element 143 from the covering 121 side and a head 149*a* of the stopper bolt 149 contacts the end surface of the cylindrical element 145, so that the rod-like element 143 is prevented from coming off.

The rod-like element 143 and the cylindrical element 145 are disposed on the both sides of the coil spring 131. As shown in FIG. 4, the rod-like element 143 and the cylindrical element 145 have a generally oval section having flat side surfaces or width across flats. Specifically, the outer surface of the rod-like element 143 and the inner surface of the cylindrical element 145 have side regions configured as vertical flat surfaces 143*a*, 145*a* and upper and lower regions configured as circular arc surfaces 143*b*, 145*b*. As shown in FIG. 5 in enlarged view, a predetermined clearance is provided between the outer surface of the rod-like element 143 and the inner surface of the cylindrical element 145. Thus, the rod-like element 143 is loosely fitted into the cylindrical element 145. A projection 147 is formed on one of the flat surface 143*a* or side region of the rod-like element 143 and the flat surface 145*a* or side region of the cylindrical element 145. In this embodiment, the projection 147 is formed on the flat surface 143*a* of the rod-like element 143 and contacts the flat surface 145*a* of the cylindrical element 145. The projection 147 causes friction (resistance to the sliding movement) by sliding in contact with the flat surface 145*a* of the cylindrical element 145 when the rod-like element 143 moves with respect to the cylindrical element 145. By this friction, vibration which is transmitted from the body 103 to the grip 123 during operation is damped. The projection 147 and the flat surface 145*a* of the cylindrical element 145 which contacts the projection 147 are features that correspond to the "sliding part" according to the invention.

The relative movement of the rod-like element 143 and the cylindrical element 145 is defined by a pivotal movement around the pivot 127. Therefore, the clearance between the circular arc surface 143*b* of the rod-like element 143 and the circular arc surface 145*b* of the cylindrical element 145 is designed to be large enough to avoid interference between the rod-like element 143 and the cylindrical element 145.

The coil spring 131 and the vibration damping mechanism 141 are covered with a rubber elastic cover 137 disposed between the mounting leg 123*a* on the upper end of the grip 123 and the covering 121. The elastic cover 137 has a bellows-like cylindrical shape. One open edge of the elastic cover 137 is fitted on the inner surface of the mounting leg 123*a* and anchored by the spring receiver 133 on the mounting leg 123 side. The other open edge of the elastic cover 137 is fastened by engaging with an annular engaging groove 139 that is formed in the covering 121.

Operation and usage of the electric hammer 101 constructed as described above will now be explained. When the trigger 115 is depressed to turn on the power switch and the driving motor 113 is driven, the rotating output of the driving motor is converted into linear motion via the crank mechanism, as mentioned above. Further, the linear motion is transmitted to the hammer bit 111 as striking movement via the striking mechanism that comprises the striker and the impact bolt. Thus, the hammering operation is performed on the workpiece. The hammering operation by the electric hammer 101 is performed while the user holds the grip 123 and applies a pressing force on the grip 123 in the direction of the body 103. When the pressing force is applied to the grip 123, the mounting leg 123*a* on the upper end of the grip 123 rotates toward the body 103 (forward) around the pivot 127. At this time, the coil spring 131 is compressed and deformed, and the head 149*a* of the stopper bolt 149 is caused to move apart from the cylindrical element 145 together with the rod-like element 143. Thus, the grip 123 is allowed to pivot in the both directions around the pivot 127 with respect to the body 103.

During such hammering operation by the electric hammer 101, impulsive and cyclic vibration is caused in the body 103 when the hammer bit 111 is driven. The input of such vibration from the body 103 to the grip 123 is reduced and attenuated by the vibration absorbing action caused by elastic deformation of the coil spring 131 and by the vibration damping action caused by friction of the vibration damping mechanism 141. Specifically, in the vibration damping mechanism 141, friction (force of inhibiting relative movement) acts upon the contact part between the projection 147 of the rod-like element 143 and the flat surface 145*a* of the cylindrical element 145 which produce sliding friction in contact with each other. By this friction, the vibration damping mechanism 141 damps vibration which is to be transmitted to the grip 123 via the coil spring 131. The coil spring 131 has a property of keeping rocking once it starts to rock. According to this embodiment, however, the rock of the coil spring 131 is controlled by friction of the vibration damping mechanism 141. Thus, the input of vibration from the body 103 to the grip 123 can be effectively reduced by the vibration absorbing action of the coil spring 131 and by the damping action caused by friction of the vibration damping mechanism 141. The degree of damping of the vibration damping mechanism 141 can be adjusted by changing the magnitude of friction that acts upon the contact part between the projection 147 and the flat surface 145*a* during sliding contact. Specifically, the magnitude of friction can be changed, for example, by changing the surface roughness, materials or area of the contact part or by changing the force acting upon the contact part in the direction perpendicular to the direction of movement.

Further, in this embodiment, the grip 123 is connected to the body 103 in a position near the source of vibration (near the travel line P of the hammer bit 111) via the coil spring 131 and the vibration damping mechanism 141. The grip 123 is also connected to the body 103 in a position remote from the source of vibration via the pivot 127 such that it can pivot in the direction of input of vibration with respect to the body 103. Thus, the vibration absorbing function of the coil spring 131 and the vibration damping function of the vibration damping mechanism 141 can be effectively performed. Further, the vibration damping mechanism 141 is disposed on the both sides of the coil spring 131 or on the both sides of the travel line P of the hammer bit 111. Therefore, movements are produced on the both sides around an axis perpendicular to the travel line P of the hammer bit 111 by the sliding contact between the projection 147 of the rod-like element 143 and the flat surface 145*a* of the cylindrical element 145, and such moments act in a manner of canceling each other out. As a result, undesired generation of moments due to provision of the vibration damping mechanism 141 is avoided.

Further, by the combined use of the coil spring 131 and the vibration damping mechanism 141, the spring constant of the coil spring 131 can be freely and easily chosen without need of considering the "unsteadiness" which may be caused between the grip 123 and the body 103 if the grip 123 is connected to the body 103 only by the coil spring 131.

Further, in this embodiment, with the construction in which the body 103 and the grip 123 are joined to each other via the pivot 127, they are prevented from relative movement except for the pivotal movement around the pivot 127. Therefore, the contact between the projection 147 of the rod-like element 143 and the flat surface 145*a* of the cylindrical element 145 can be held in a constant state, so that the friction in the sliding part can be stabilized. Further, the sliding part that comprises the projection 147 and the flat surface 145*a* is provided on the side regions of the rod-like element 143 and the cylindrical element 145. Thus, the sliding part can be linearly configured on the rod-like element 143 and the cylindrical element 145 that pivot on the pivot 127 with respect to each other. Therefore, the sliding contact part can be easily provided while maintaining stable friction.

Figure 7:
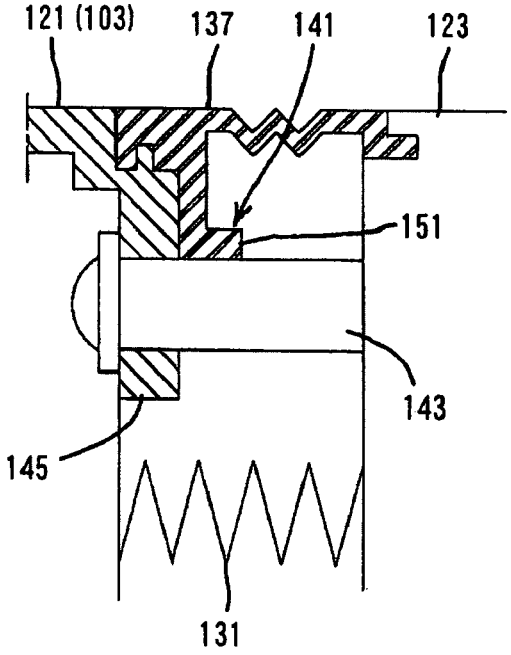
FIG. 7 schematically shows a modification of a vibration damping mechanism.
Figure 8:
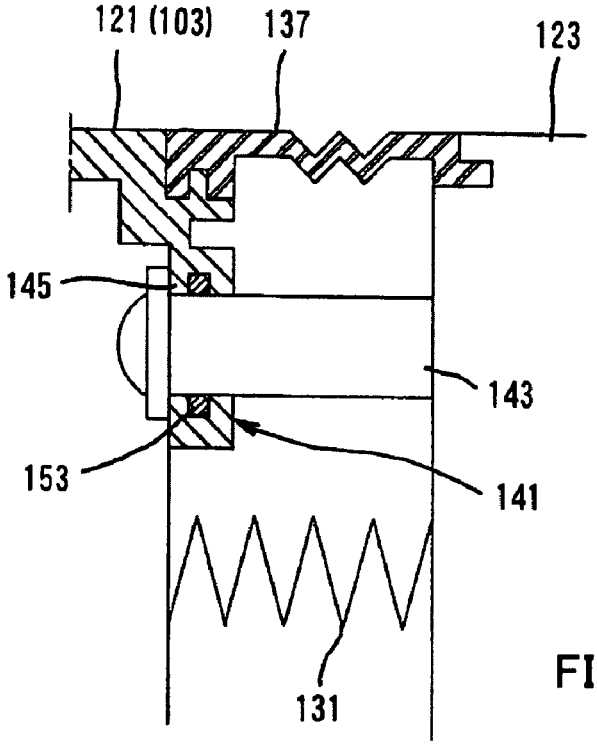
FIG. 8 schematically shows a modification of the vibration damping mechanism.

Now, modifications of the vibration damping mechanism 141 will be explained with reference to FIGS. 7 to 9.

In the above-mentioned embodiment, the cylindrical element 145 made of synthetic resin is in frictional contact with the rod-like element 143 made of metal. However, in the modification shown in FIG. 7, the rubber elastic cover 137 is in frictional contact with the metal rod-like element 143. Specifically, an arm 151 is integrally formed with the elastic cover 137 and extends toward the rod-like element 143. The end of the arm 151 is pressed against the rod-like element 143 by a predetermined pressing force from a direction crossing the direction of movement of the rod-like element 143. In this state, the arm 151 slides with respect to the rod-like element 143. In another modification shown in FIG. 8, an O-ring 153 is additionally disposed on the engaging surface between the rod-like element 143 and the cylindrical element 145 in the above-mentioned embodiment. According to the modifications shown in FIGS. 7 and 8, by utilizing the elastic deformation of the arm 151 and the O-ring 153, a required biasing force can be applied to the sliding surface in a direction crossing the sliding direction. Further, the pivotal movement of the rod-like element 143 around the pivot 127 can be accommodated by the elastic deformation. Therefore, the rod-like element 143 may have, for example, a simple circular shape in section in order to enhance the manufacturability.

Figure 9:
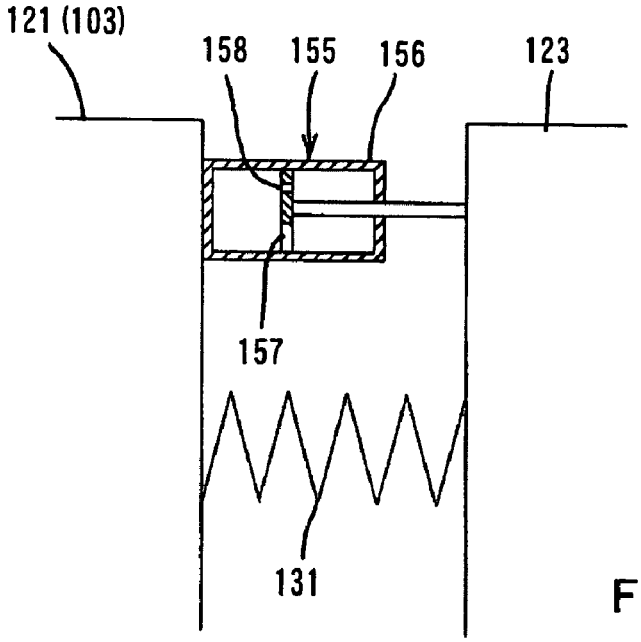
FIG. 9 schematically shows a modification of the vibration damping mechanism.

Further, according to a different modification as shown in FIG. 9, the vibration damping mechanism 141 comprises a fluid damper 155. The fluid damper 155 includes a cylinder 156 mounted on the body 103 and a piston 157 mounted on the grip 123. The piston 157 moves within the cylinder 156 when the body 103 and the grip 123 move with respect with each other. At this time, fluid resistance of the fluid passing through an orifice 158 within the cylinder 156 is utilized as a vibration damping force. Further different constructions other than the above-mentioned modifications can also be applied. For example, a plate spring or a resin spring may be provided and engaged with the friction sliding surface of the rod-like element 143 while applying the biasing force in a direction perpendicular to the direction of movement of the rod-like element 143.

Instead of utilizing the coil spring 131 as an elastic element, a rubber may be used. Further, as to the mounting leg 123*b* on the lower end of the grip 123 rotatably connected to the body via the pivot 127, it may be connected to the body via the coil spring 131 and the vibration damping mechanism 141 in the same manner as the mounting leg 123*a* on the upper end Further, the friction sliding part is formed by the projection 147 and the flat surface 145*a* in this embodiment, but it may be formed by opposed flat surfaces. As for the projection 147 provided between the rod-like element 143 and the cylindrical element 145, one or more projections 147 may be provided between each paw of the opposed flat surfaces 147, or the projections 147 may continuously extend in the direction of the relative movement. In this case, the surface of the projecting end of the projection 147 which contacts the opposed flat surface 145*a* may comprise a flat surface or a spherical surface.

Further, in this embodiment, the electric hammer is described as a representative example of the reciprocating power tool. However, the invention may also be applied to a hammer drill which performs a drilling operation on a workpiece by causing a tool bit or a hammer bit to perform hammering movement in the axial direction and rotation in the circumferential direction. In addition to the impact power tools such as an electric hammer and a hammer drill, the invention may also be applied to cutting tools such as a reciprocating saw or a jig saw which perform a cutting operation on a workpiece by causing a tool bit or a blade to perform a reciprocating movement.

Further, the vibration damping part may be disposed on the both sides of a travel line of the tool bit. With such construction, moments produced on the both sides around an axis perpendicular to the travel line of the tool bit by the vibration damping action of the vibration damping part are canceled out to each other. As a result, undesired generation of moments due to provision of the vibration damping mechanism is avoided. Further, the vibration damping part may be disposed on the both sides of the travel line of the tool bit typically in such a manner that the sliding surfaces on the both sides of the travel line extend parallel to each other.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

DESCRIPTION OF NUMERALS

101 electric hammer (reciprocating power tool)
103 body (tool body)
105 motor housing
107 gear housing
109 tool holder
111 hammer bit (tool bit)
113 handgrip
115 trigger
121 covering
123 grip
123*a* mounting leg on the upper end
123*b* mounting leg on the lower end
127 pivot
131 coil spring
133 spring receiver
135 spring receiver
137 elastic cover
139 engaging groove
141 vibration damping mechanism (vibration damping part)
143 rod-like element
143*a* flat surface
143*b* circular arc surface
145 cylindrical element
145*a* flat surface
145*b* circular arc surface
147 projection (sliding part)
149 stopper bolt
149*a* head
151 arm
153 O-ring
155 fluid damper
156 cylinder
157 piston
158 orifice

What we claim is:

1. A reciprocating power tool comprising:

an actuating mechanism that drives a tool bit that performs a predetermined operation to the work by reciprocating in an axial direction;

a tool body that houses the actuating mechanism;

a grip that is rotatably mounted on a rear end of the tool body on a side opposite to the tool bit, the grip being connected to the tool body by two connecting units disposed at an upper region and a lower region of the tool body, the lower connecting unit comprising a pivot about which the grip rotates with respect to the tool body;

an elastic element resiliently disposed between the tool body and the grip as a part of the upper connecting unit, the elastic element absorbing vibration transmitted from the tool body to the grip during operation of the reciprocating power tool by receiving a deforming force in a longitudinal direction of the tool bit; and a vibration damping part disposed between the tool body and the grip with the elastic element as another part of the upper connecting unit to damp and attenuate the vibration, wherein the vibration damping part comprises a body-side sliding part disposed on the tool body and a grip-side sliding part disposed on the grip and slidably connected to the body-side sliding part, the vibration damping part being configured to attenuate the vibration by friction produced when the body-side sliding part and the grip-side sliding part move in contact with each other upon transmission of the vibration, one of the body-side sliding part and the grip-side sliding part includes a rod-like element and the other of the body-side sliding part and the grip-side sliding part includes a cylindrical element into which the rod-like element is inserted so that the vibration is damped and attenuated by friction produced on the sliding contact surface between the rod-like element and the cylindrical element, and a projection is formed on a side region of the rod-like element by which the contact between the rod-like element and the cylindrical element can be maintained in a constant state.

2. The reciprocating power tool as defined in claim 1, wherein the material of the rod-like element and the material of the cylindrical element are different from each other.

3. The reciprocating power tool as defined in claim 1, wherein the rod-like element is made of metal and the cylindrical element is made of synthetic resin.

4. A reciprocating power tool comprising:

an actuating mechanism that drives a tool bit that performs a predetermined operation to the work by reciprocating in an axial direction;

a tool body that houses the actuating mechanism;

a grip that is rotatably mounted on a rear end of the tool body on a side opposite to the tool bit, the grip being connected to the tool body by two connecting units disposed at an upper region and a lower region of the tool body, the lower connecting unit comprising a pivot about which the grip rotates with respect to the tool body;

an elastic element resiliently disposed between the tool body and the, grip as a part of the upper connecting unit, the elastic element absorbing vibration transmitted from the tool body to the grip during operation of the reciprocating power tool by receiving a deforming force in a longitudinal direction of the tool bit; and a vibration damping part disposed between the tool body and the grip with the elastic element as another part of the upper connecting unit to damp and attenuate the vibration, wherein the vibration damping part comprises a body-side sliding part disposed on the tool body and a grip-side sliding part disposed on the grip and slidably connected to the body-side sliding part, the vibration damping part being configured to attenuate the vibration by friction produced when the body-side sliding part and the grip-side sliding part move in contact with each other upon transmission of the vibration, one of the body-side sliding part and the grip-side sliding part includes a rod-like element and the other of the body-side sliding part and the grip-side sliding part includes a cylindrical element into which the rod-like element is inserted so that the vibration is damped and attenuated by friction produced on the sliding contact surface between the rod-like element and the cylindrical element, an O-ring is disposed on an engaging surface between the rod-like element and the cylindrical element, and the rod-like element contacts with the cylindrical element via the O-ring at a side region by which the contact between the rod-like element and the cylindrical element can be maintained in a constant state.

5. A reciprocating power tool comprising:

an actuating mechanism that drives a tool bit that performs a predetermined operation to the work by reciprocating in an axial direction;

a tool body that houses the actuating mechanism;

a grip mounted on a rear end of the tool body on a side opposite to the tool bit;

an elastic element resiliently disposed between the tool body and the grip, the elastic element absorbing vibration transmitted from the tool body to the grip during operation of the reciprocating power tool by receiving a deforming force in a longitudinal direction of the tool bit; and a vibration damping part disposed between the tool body and the grip to damp and attenuate the vibration, wherein the vibration damping part comprises a body-side sliding part disposed on the tool body and a grip-side sliding part disposed on the grip and slidably connected to the body-side sliding part to form a fluid damper, the fluid damper including a cylinder mounted on one of the tool body and the grip and a piston mounted on the other of the tool body and the grip, so that said vibration is damped and attenuated by fluid resistance within the fluid damper.

6. A reciprocating power tool comprising:

an actuating mechanism that drives a tool bit that performs a predetermined operation to the work by reciprocating in an axial direction;

a tool body that houses the actuating mechanism;

a grip that is rotatably mounted on a rear end of the tool body on a side opposite to the tool bit, the grip being connected to the tool body by two connecting units disposed at an upper region and a lower region of the tool body, the lower connecting unit comprising a pivot about which the grip rotates with respect to the tool body;

an elastic element resiliently disposed between the tool body and the grip as a part of the upper connecting unit, the elastic element absorbing vibration transmitted from the tool body to the grip during operation of the reciprocating power tool by receiving a deforming force in a longitudinal direction of the tool bit; and a vibration damping part disposed between the tool body and the grip with the elastic element as another part of the upper connecting unit to damp and attenuate the vibration, wherein the vibration damping part comprises a body-side sliding part disposed on the tool body and a grip-side sliding part disposed on the grip and slidably connected to the body-side sliding part, the vibration damping part being configured to attenuate the vibration by friction produced when the body-side sliding part and the grip-side sliding part move in contact with each other upon transmission of the vibration, one of the body-side sliding part and the grip-side sliding part includes a rod-like element and the other of the body-side sliding part and the grip-side sliding part includes a cylindrical element into which the rod-like element is inserted so that the vibration is damped and attenuated by friction produced on the sliding contact surface between the rod-like element and the cylindrical element, the grip extends in a direction crossing the axial direction of the tool bit, the two connecting units including mounting legs that extend from upper and lower ends of the grip in a direction generally parallel to the axial direction of the tool bit, the pivot is provided in the lower end mounting leg, and a projection is formed on a side region of the rod-like element by which the contact between the rod-like element and the cylindrical element can be maintained in a constant state.

7. The reciprocating power tool as defined in claim 6, wherein the upper end mounting leg of the grip performs a circular arc motion generally in the same direction as the axial direction of the tool bit upon pivotal movement of the grip with respect to the tool body, and wherein the direction of action of the spring force of the elastic element generally coincides with the direction of said circular arc motion.

8. A reciprocating power tool comprising:

an actuating mechanism that drives a tool bit that performs a predetermined operation to the work by reciprocating in an axial direction;

a tool body that houses the actuating mechanism;

a grip that is rotatably mounted on a rear end of the tool body on a side opposite to the tool bit, the grip being connected to the tool body by two connecting units disposed at an upper region and a lower region of the tool body, the lower connecting unit comprising a pivot about which the grip rotates with respect to the tool body;

an elastic element resiliently disposed between the tool body and the grip as a part of the upper connecting unit, the elastic element absorbing vibration transmitted from the tool body to the grip during operation of the reciprocating power tool by receiving a deforming force in a longitudinal direction of the tool bit;

a vibration damping part disposed between the tool body and the grip with the elastic element as another part of the upper connecting unit to damp and attenuate the vibration; and a rubber elastic cover that elastically connects the tool body and the grip, and a receiver that mounts the elastic element to the grip, wherein the receiver also fastens the elastic cover to the grip, the vibration damping part comprises a body-side sliding part disposed on the tool body and a grip-side sliding part disposed on the grip and slidably connected to the body-side sliding part, the vibration damping part being configured to attenuate the vibration by friction produced when the body-side sliding part and the grip-side sliding part move in contact with each other upon transmission of the vibration, one of the body-side sliding part and the grip-side sliding part includes a rod-like element and the other of the body-side sliding part and the grip-side sliding part includes a cylindrical element into which the rod-like element is inserted so that the vibration is damped and attenuated by friction produced on the sliding contact surface between the rod-like element and the cylindrical element, and a projection is formed on a side region of the rod-like element by which the contact between the rod-like element and the cylindrical element can be maintained in a constant state.

* * * * *